US008251493B2

(12) United States Patent
Sekino et al.

(10) Patent No.: US 8,251,493 B2
(45) Date of Patent: Aug. 28, 2012

(54) RECORDING APPARATUS

(75) Inventors: Takeshi Sekino, Kawasaki (JP); Masahiro Taniguro, Yokohama (JP); Takashi Nojima, Tokyo (JP); Hiroki Tajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 757 days.

(21) Appl. No.: 12/422,521

(22) Filed: Apr. 13, 2009

(65) Prior Publication Data

US 2009/0195625 A1 Aug. 6, 2009

Related U.S. Application Data

(62) Division of application No. 11/400,510, filed on Apr. 10, 2006, now Pat. No. 7,537,312.

(30) Foreign Application Priority Data

Apr. 27, 2005 (JP) ..... 2005-129409

(51) Int. Cl.
*B41J 2/14* (2006.01)
*B41J 2/175* (2006.01)

(52) U.S. Cl. ..... 347/49; 347/86

(58) Field of Classification Search ..... 347/49, 347/50, 87, 85
See application file for complete search history.

(56) References Cited

U.S. PATENT DOCUMENTS

| | | | | |
|---|---|---|---|---|
| 4,907,018 | A | 3/1990 | Pinkerpell et al. | 346/139 R |
| 5,392,063 | A | 2/1995 | Rhoads | 347/49 |
| 5,519,422 | A | 5/1996 | Thoman et al. | |
| 5,784,082 | A | 7/1998 | Shinmachi et al. | |
| 6,196,670 | B1 * | 3/2001 | Saruta | 347/86 |
| 6,224,192 | B1 | 5/2001 | Robinson et al. | 347/49 |
| 6,290,346 | B1 | 9/2001 | Santhanam et al. | 347/86 |
| 6,471,334 | B2 | 10/2002 | Kline et al. | 347/49 |
| 6,488,369 | B1 * | 12/2002 | Steinmetz et al. | 347/86 |
| 6,955,422 | B2 * | 10/2005 | Miyazawa et al. | 347/86 |
| 7,537,312 | B2 * | 5/2009 | Sekino et al. | 347/49 |
| 2001/0006393 | A1 | 7/2001 | Kline et al. | |
| 2007/0008366 | A1 | 1/2007 | Nojima et al. | |

FOREIGN PATENT DOCUMENTS

| | | |
|---|---|---|
| CN | 1393340 | 1/2003 |
| CN | 1420821 | 5/2003 |
| EP | 0 590 669 | 4/1994 |
| EP | 0 602 020 | 6/1994 |
| JP | 2004-90343 | 3/2004 |
| JP | 2004-249596 A | 9/2004 |

* cited by examiner

*Primary Examiner* — Anh Thi Ngoc Vo

(74) *Attorney, Agent, or Firm* — Fitzpatrick, Cella, Harper & Scinto

(57) ABSTRACT

A recording apparatus which can prevent a drop of a recording head upon attachment of the recording head to a carriage is provided. When a head cartridge is attached/removed to/from a carriage, the carriage is moved to an overlapping position with a head supporting base and stopped there. Projection supporting portions to guide and support rough guide projections on both side surfaces of the head cartridge so as to be properly received to guides provided for the carriage are provided for the head supporting base.

8 Claims, 11 Drawing Sheets

RECORDING APPARATUS

BACKGROUND OF THE INVENTION

1. Field of the Invention

The invention relates to an image recording apparatus and, more particularly, to an ink jet recording apparatus for recording by discharging ink from recording means which has removably been attached onto a carriage which is movable along a recording medium.

2. Related Background Art

In recent years, image information can be easily handled owing to the spread of personal computers, digital cameras, and the like and a demand for an easy-to-use recording apparatus as an output apparatus is increasing. Among recording systems which are used for the recording apparatuses, there is an ink jet recording system known as a relatively small and reasonable system which enables fine recording.

In the recording apparatus using the ink jet recording system, a carriage on which recording means (a recording head or a head cartridge in which the recording head and an ink tank unit are integratedly assembled) having tens to hundreds ink discharge ports has been attached is constructed so that it is coupled with a part of a driving belt for transferring a driving force of a carriage driving motor and is movable.

According to the above structure, the recording means can be moved along a platen arranged so as to face the discharge surface and, during the movement, the recording means moves (scans) reciprocatively the whole width of the recording medium (medium to be recorded) which is conveyed on the platen, thereby enabling the recording to be executed. The recording medium is conveyed by conveying means every scan of the carriage by a distance which is determined in accordance with a pitch of the discharge ports. The recording is executed onto the whole surface of the recording medium by repeating the above-mentioned scan and conveyance of the recording medium.

Among the ink jet recording apparatuses in which the head cartridge is removably attached onto the carriage, there is an apparatus constructed in such a manner that when the ink in the head cartridge is fully consumed or when the head cartridge fails, it is replaced by a new head cartridge, thereby enabling the recording apparatus to be easily recovered to a recording possible state. Among the recent ink jet recording apparatuses having the advanced functions, an ink jet recording apparatus constructed in such a manner that by replacing a regular head cartridge for monochromatic printing by an optional head such as a head cartridge for photo-printing or the like, a photo-image of a photographic tone or the like can be recorded has also been spread.

In the conventional carriage structure, in order to electrically couple the head cartridge with the recording apparatus main body, a board (head board) having a conductor exposing portion onto which 'regist' is not applied or a flexible printed circuit board (FPC) is provided on the head cartridge side. There are many cases where a pressure contact connector to electrically couple the head cartridge with the conductor exposing portion of the head cartridge is provided for the carriage to attach (or mount) the head cartridge. The pressure contact connector is ordinarily formed by plating a metal and is come into pressure contact with the conductor exposing portion of the head cartridge by using an elastic deformation of the metal. Further, the pressure contact connector is soldered to a board (carriage board) attached in the carriage. Moreover, the board on the carriage is electrically coupled with a circuit board (control circuit) of an apparatus main body side through a flexible flat cable (FFC), the FPC, or the like.

As a foregoing related art, a structure in which a fixing member for fixing the recording means enclosed in the carriage is rotatably provided for the carriage and an operating unit which applies a force to rotate the fixing member is provided for the fixing member has been disclosed in Japanese Patent Application Laid-Open No. 2004-090343. However, in order to press the recording means to the pressure contact connector of the carriage, a large force is necessary in dependence on the number of electrical contacts between the recording means and the carriage. Thus, when the recording means is attached to the carriage, a very large operating force is needed. Therefore, in order to prevent the deformation of the fixing member for fixing the recording means to the carriage, it is necessary that a special material having high rigidity is used for a mechanical portion of the fixing member, or in order to reduce the operating force of the fixing member, it is necessary to use a complicated link mechanism.

In the conventional recording means such as a head cartridge or the like and the attachment fixing structure to a plurality of recording means enclosing portions provided for the carriages in order to attach the recording means, each recording means has substantially the same external shape and a color indication is provided on the recording means, thereby paying attention to the user so as to attach the recording means of a predetermined color to a predetermined position of such a structure. However, if such a construction is merely used, there is such a problem that, according to the attachment fixing structure to a plurality of recording means enclosing portions provided for the carriages, the situation where the recording means of the wrong color is attached cannot be completely prevented and there is a troublesomeness upon recording.

To solve such a problem, in U.S. Pat. No. 5,519,422, there has been disclosed a construction in which projections such as tabs, wings, or the like of different positions or different numbers are provided for the recording means, and in a plurality of recording means enclosing portions provided for the carriages of the recording apparatus main body, the erroneous attachment of recording means out of the standard is prevented by changing a size or a position of a barrier provided in a bottom portion of each enclosing portion.

According to the construction disclosed in Japanese Patent Application Laid-Open No. 2004-090343, when the recording means is replaced, it is necessary to insert it into the carriage from an upper direction of the recording apparatus main body. Since the operating unit is provided for the fixing member of the recording means, the user fixes the recording means to the carriage in a pressing state by rotating the fixing member together with the operating unit. In such a case, it is necessary to sufficiently widely assure a space where the recording means can pass or a space where the operating unit rotates by opening a cover in an upper portion of the apparatus main body.

Further, in recent years, an apparatus such as an ink jet hybrid apparatus (multi-function printer: MFP) in which an ink jet recording apparatus and a flat bed scanner are combined and a copy or the like of an original sheet (or paper) can be performed has also been wide-spread. In such a multi-function printer, since an original sheet reading unit is provided in an upper portion of the recording apparatus, when the recording means is attached onto the carriage, it is necessary to insert the recording means into a deep position of the apparatus while it is sandwiched, so that there is a problem that the operation of the user is troublesome. In such a problem, to improve the operability of the user, an opening portion of the apparatus main body from which the user accesses the carriage has to be widened by increasing the whole recording apparatus.

Further, according to such a construction, since it is necessary to grasp the recording means until it is certainly attached onto the carriage, if the user erroneously operates, there is a fear of dropping of the recording means. Also, when the recording means is attached/removed to/from the carriage, if the user does not certainly grasp the recording means, he will drop it. Since the ink discharge portion of the ink jet recording head is very delicate and clogging or a damage is liable to occur, not only the recording head is broken by the drop of the recording means but also it cannot be used due to a deposition of dust or the like. It is, therefore, an important subject to prevent the drop of the recording means which is caused when the user executes the attaching/removing operation to/from the apparatus main body.

Since the apparatus disclosed in Japanese Patent Application Laid-Open No. 2004-090343 has the construction in which the recording means is inserted into the carriage from almost the upper direction of the recording apparatus main body, even if the wrong carriage is inserted into the recording means enclosing portion, it is kept placed on the carriage due to an own weight of the recording means itself. Thus, the carriage executes the operation similar to that in the case where the recording means is not attached, so that a maintenance unit of the recording means is carelessly made dirty, the recording means or the recording apparatus main body is electrically short-circuited, or the recording means or the recording apparatus is broken by the unreasonable scan of the carriage.

Further, in the case of the ink jet multi-function printer which has been wide-spread in recent years as mentioned above, since it is inevitably necessary to attach the recording means onto the carriage arranged in the deep position of the apparatus, it is very difficult for the user to confirm by the eyes whether or not the recording means has correctly been attached. For example, even if the user tries to discriminate about the correct/erroneous attachment of the recording means by a tactile sensation of the hand by which the recording means has been inserted, particularly, in the case where he attaches the recording means for the first time, the correct attaching position to the carriage is obscure, and thus there is such a problem that it is difficult for the user to discriminate whether or not the recording means has correctly been attached.

It is, therefore, an important subject to prevent the erroneous attachment at the time of the attaching/removing operation of the recording means to/from the apparatus main body and enable the user to easily discriminate the correct/erroneous attachment of the recording means.

SUMMARY OF THE INVENTION

It is an object of the invention to provide an ink jet recording apparatus in which recording means can be attached/removed to/from a carriage without dropping it.

Another object of the invention is to provide an ink jet recording apparatus which enables the user to recognize the erroneous attachment.

Still another object of the invention is to provide a recording apparatus for recording by recording means, comprising: a carriage on which the recording means is removably attached and which is movable along a recording sheet; and a supporting base for guiding the recording means to the carriage and supporting it when the carriage is stopped in an exchange position where the recording means can be attached/removed to/from the carriage.

DETAILED DESCRIPTION OF THE PREFERRED EMBODIMENTS

Figure 1:
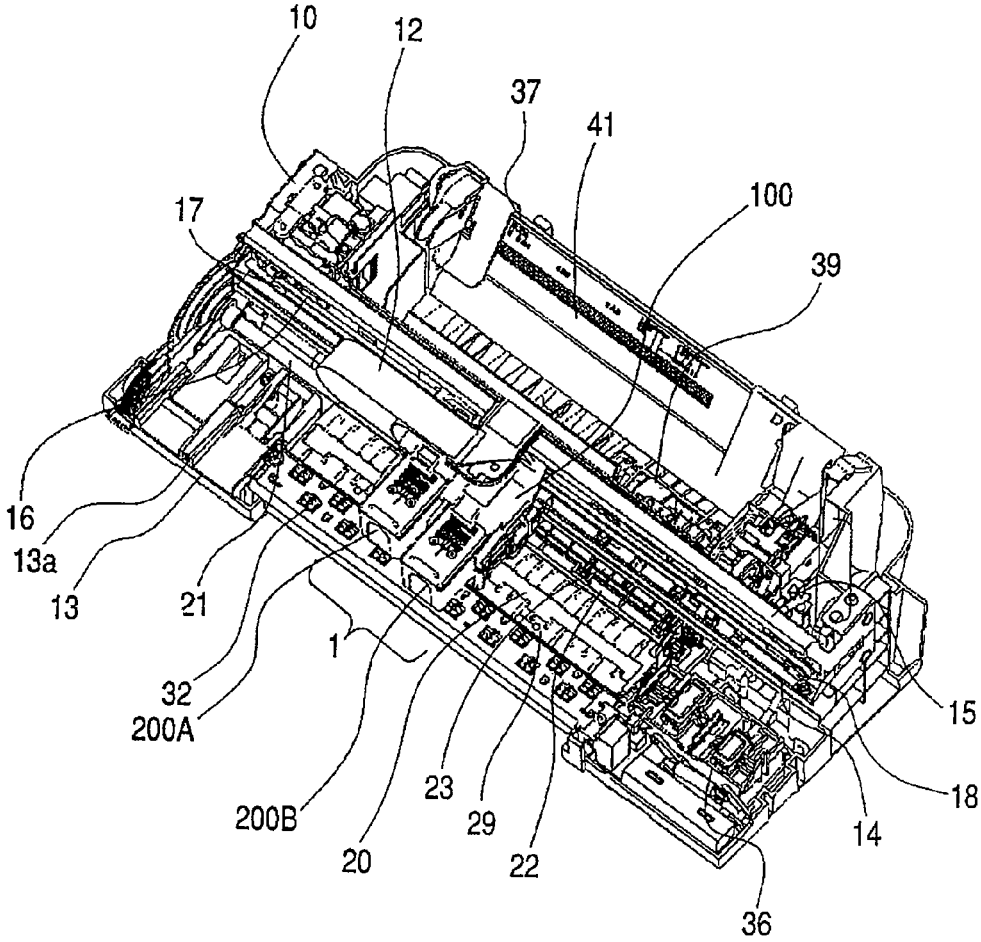
FIG. 1 is a perspective view showing a whole construction of an ink jet recording apparatus according to the first embodiment of the invention.

Embodiments of the invention will be described in detail hereinbelow with reference to the drawings. The same or corresponding component elements in the drawings are designated by the same reference numerals.

First Embodiment

FIG. 1 is a perspective view showing a whole construction of the first embodiment of a recording apparatus of the invention and shows the case where the recording apparatus of the embodiment is an ink jet recording apparatus for recording onto a recording medium (to be recorded) by discharging ink.

The recording apparatus of the embodiment shown in FIG. 1 is mainly constructed by: a sheet feed unit 37; a conveying unit 20; a recording unit 1; and a maintenance unit 36 for recovering head cartridges 200A and 200B. Recording data is sent from a host apparatus (not shown) and stored by a recording apparatus control unit (not shown) on a control circuit board. A recording operation start command is generated from the control unit and the recording operation is started. The maintenance unit 36 caps ink discharge port portions of the head cartridges 200A and 200B, which will be explained hereinafter, and sucks ink from the ink discharge ports, thereby recovering the insides of the ink discharge ports to a normal state.

When the recording is started, first, the sheet feeding operation is executed. The sheet feed unit 37 is a main ASF (Automatic Sheet Feeder). The sheet feed unit 37 is constructed by an automatic sheet feed unit for picking up recording sheets (or recording paper) one by one every recording operation from a plurality of recording sheets stacked on a pressing plate 41 and sending the picked-up sheet to a conveying unit. An ASF motor (not shown) is rotated in the forward direction at the start of the sheet feeding operation and its motive power is transferred through a gear train and rotates a cam which holds the pressing plate 41. When the cam is disengaged by the rotation of the ASF motor, the pressing plate 41 is urged toward a sheet feed roller 39 by the operation of a pressure plate spring (not shown). At the same time, since the sheet feed roller 39 is rotated in such a direction as to convey the recording sheet, the conveyance of the top one of the stacked recording sheets is started. At this time, there may occur a situation where a plurality of recording sheets are simultaneously fed out due to conditions of a frictional force between the sheet feed roller 39 and the recording sheet and the frictional force between the recording sheets.

In such a case, a separating roller (not shown) which is come into pressure contact with the sheet feed roller 39 and has a predetermined return rotational torque in the direction opposite to the recording sheet conveying direction acts. At this time, the separating roller functions so as to press and return the recording sheets other than the recording sheet locating at the nearest position on the sheet feed roller 39 side onto the original pressure plate. When the ASF sheet feeding operation is finished, the separating roller is released from the pressure contact state with the sheet feed roller 39 by the operation of the cam and is separated at a predetermined distance. At this time, in order to certainly press and return the recording sheets to a predetermined position on the pressure plate, a return claw (not shown) rotates and plays its role. By the operation as mentioned above, only one recording sheet is conveyed to the conveying unit.

The recording sheet conveyed from the sheet feed unit is conveyed toward a nipping portion of a conveying roller 21 and a pinch roller 22 serving as a conveying unit. Since the pinch roller 22 is attached so that its center is slightly offset from a center of the conveying roller 21 in such a direction as to approach a first sheet ejecting roller (not shown), an angle in the tangential direction where the recording sheet is inserted is slightly inclined from the horizontal direction. Therefore, an angle is formed by a sheet passing path which is formed by a pinch roller holder 23 and a guide member (paper passing guide) (not shown) and the recording sheet is conveyed with such an angle so that a front edge of the recording sheet is accurately guided to the nipping portion.

The front edge of the recording sheet which is conveyed by the sheet feed unit (main ASF) 37 is abutted to the nipping portion of the conveying roller 21 in the stop state. At this time, by conveying the recording sheet by the sheet feed unit 37 by a distance which is slightly longer than a predetermined sheet passing path length, a loop of the recording sheet is formed between the sheet feed roller 39 and the conveying roller 21. The front edge of the recording sheet is pressed to the nipping portion of the conveying roller 21 by a force which is generated when the loop intends to be returned in the straight state, so that the front edge of the recording sheet becomes parallel along the conveying roller 21 and, what is called a registration operation is completed. After completion of the registration operation, the rotation (rotation in the forward direction) of an LF motor (conveying motor) (not shown) is started in such a direction that the recording sheet is moved in the forward direction (direction in which it progresses toward the first sheet ejecting roller).

After that, the driving force of the sheet feed roller 39 is cut, so that the roller 39 is rotated in association with the recording sheet. At this point of time, the recording sheet is conveyed only by the conveying roller 21 and the pinch roller 22. The recording sheet advances in the forward direction every predetermined line-feeding amount and progresses along ribs provided for a platen 29.

The front edge of the recording sheet is gradually sandwiched in a nipping portion of the first sheet ejecting roller (not shown) and a first gear (spur) train 32 and in a nipping portion of a second sheet ejecting roller (not shown) and a second gear (spur) train (not shown). A peripheral speed of each of the first sheet ejecting roller and the second sheet ejecting roller is set to be almost equal to that of the conveying roller 21. Further, the conveying roller 21 and the first and second sheet ejecting rollers are connected by gear trains. Therefore, the first and second sheet ejecting rollers are rotated synchronously with the conveying roller 21, so that the recording sheet is conveyed without being loosened or stretched.

The recording unit 1 is mainly constructed by: the head cartridges 200A and 200B serving as recording means; and a carriage 100 on which the head cartridges 200A and 200B are attached (or mounted) and which scans (moves) in the direction which crosses (normally, crosses perpendicularly) the recording sheet conveying direction. The carriage 100 is guided and supported by a guide rail 14 fixed to a chassis 10 and a supporting rail 15 as a part of the chassis 10. By transferring a driving force of a carriage motor 17 to the carriage 100 through a carriage belt 16 suspended between the carriage motor 17 and an idler pulley 18, the carriage 100 is reciprocatively moved (scanned).

A plurality of ink flow paths are formed in each of the head cartridges 200A and 200B. Each ink flow path is communicated with a discharge port arranged in the surface (discharge port surface) which faces the platen 29. An actuator (energy generating means) for discharging the ink is arranged in each of a plurality of discharge ports forming a discharge port train. As an actuator, for example, an element using a film boiling pressure of a liquid by an electrothermal converting element (heating element), an electromechanical converting element (electro-pressure converting element) such as a piezo electric element, or the like is used.

In order to electrically couple the head cartridges 200A and 200B with the recording apparatus main body, a flexible printed circuit board (FPC) having conductor exposing portions onto which the 'regist' is not applied is provided on the side of the head cartridges 200A and 200B. Pressure contact connectors (not shown) which are formed by plating a metal, are come into pressure contact with the conductor exposing portions of the head cartridges 200A and 200B by using elastic deformation of the metal, and are electrically connected to the conductor exposing portions of the head cartridges 200A and 200B are provided for the carriage 100. Further, the pressure contact connectors are soldered to a board (carriage board) attached onto the carriage 100. The board on the carriage 100 is electrically connected to a printed circuit board (control circuit) on the apparatus main body side through a flexible flat cable (FFC) 12.

In the ink jet recording apparatus as mentioned above, by supplying a signal of a head driver (not shown) through the flexible flat cable (FFC) 12 to the head cartridges 200A and 200B, ink droplets can be discharged in accordance with the recording data. A cord strip (not shown) suspended to the chassis 10 is read by an encoder (not shown) attached on the carriage 100, so that the ink droplets can be discharged toward the recording sheet at proper timing. When the recording of one line is finished as mentioned above, the recording sheet is conveyed by a necessary amount by the conveying unit. By repetitively executing such an operation, the recording operation can be executed to the whole surface of the recording sheet.

Figure 2A:
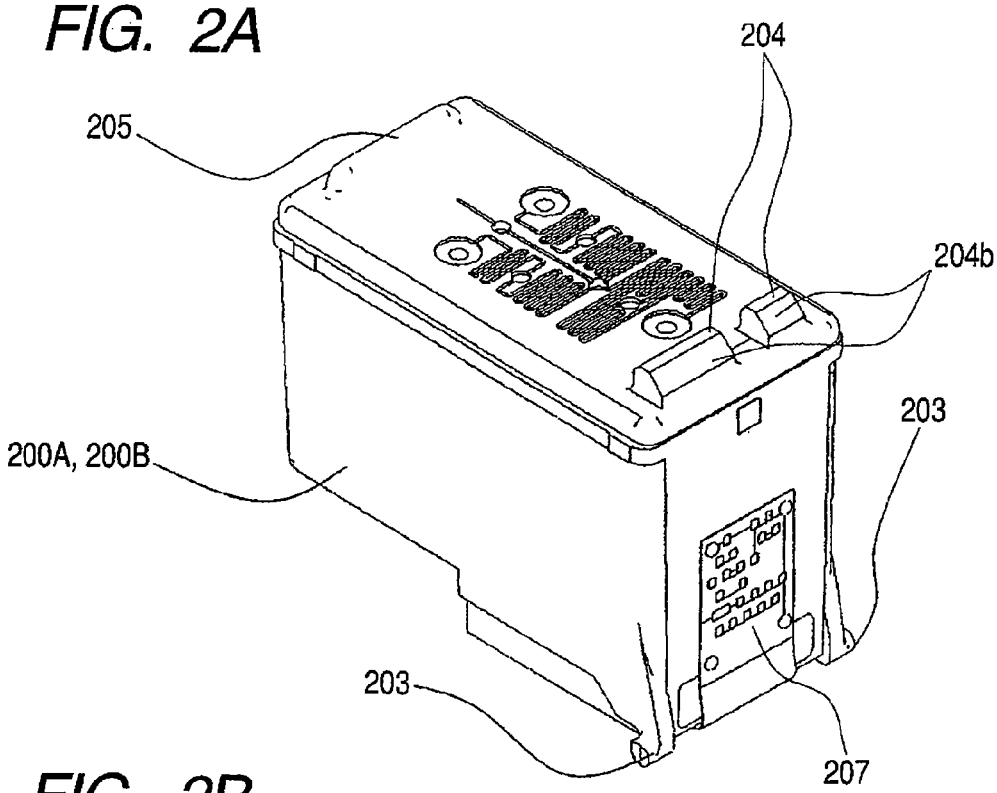
FIGS. 2A and 2B are perspective views showing a head cartridge of the ink jet recording apparatus according to the first embodiment of the invention.
Figure 2B:
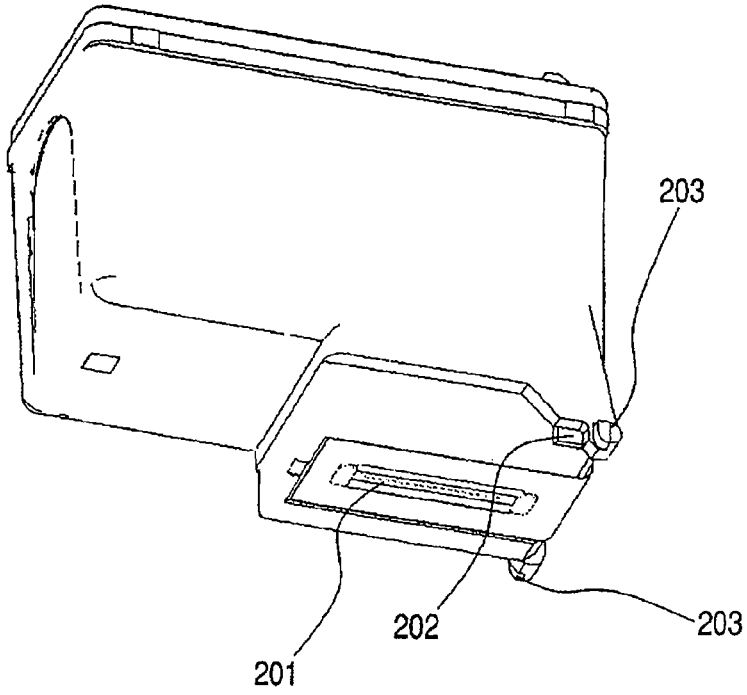

FIGS. 2A and 2B are perspective views showing the head cartridge as recording means. In the embodiment, an exchangeable head cartridge in which a recording head for discharging recording liquid droplets such as ink or the like and a liquid tank portion (ink tank) are integrated is used as recording means. In the case of executing the ordinary color recording by the recording apparatus, the head cartridge for monochromatic printing (also referred to as a black cartridge hereinbelow) 200A is attached in one of the two recording means enclosing portions arranged in the carriage 100. The head cartridge for color printing of three colors of cyan, magenta, and yellow (also referred to as a color cartridge hereinbelow) 200B is attached in the other recording means enclosing portion. In the case of recording in a photo color of a photograph tone, a photo cartridge (black, pale cyan, pale magenta) (not shown) as an optional head can be also used in place of the black cartridge. In the case of using the recording apparatus as a scanner, a scanner head (not shown) as an optional head can be also used in place of the black cartridge or the color cartridge. Each of the head cartridges 200A and 200B and the photo cartridge or scanner head as an optional head has almost the same shape dimensions.

As shown in FIG. 2A, the surface of the head cartridge 200A (200B) on the side where it faces the front side when it is attached to the carriage has a conductor exposing portion 207 which is electrically connected to the pressure contact connector of the carriage 100. The surface having the conductor exposing portion 207 is called a contact surface. Head pressure receiving portions 204 are formed on the upper surface of the head cartridge 200A (200B) on the side near the contact surface. Cam rotation oblique surfaces 204*b* for allowing the rotation of headset cams (110 in FIGS. 4, 5, 6, 7 and 8) serving as fixing members to be smoothly performed are formed on the surface of the head pressure receiving portions 204 on the contact surface side. As shown in FIG. 2B, positioning grooves 202 are formed in lower portions of both side surfaces of the head cartridge 200A (200B) on the side where they sandwich the contact surface. Rough guide projections 203 are formed at the positions of the both side surfaces of the head cartridge 200A (200B) locating on the contact surface side ahead of the positioning grooves 202. An ink discharge portion 201 in which ink discharge ports are arranged in the direction which crosses the moving direction of the carriage 100 is attached to a lower surface (called a face surface) of the head cartridge 200A (200B).

Figure 3:
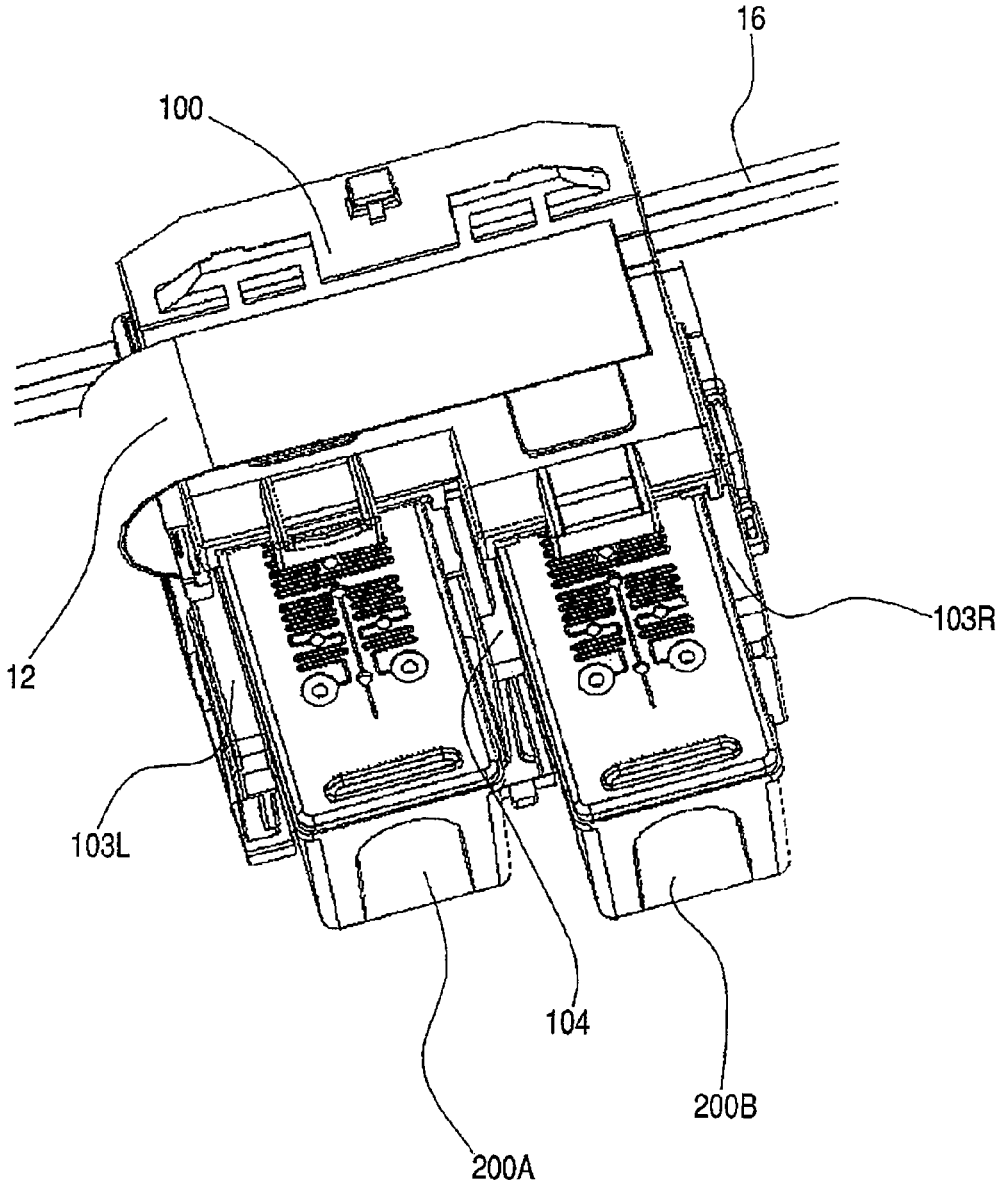
FIG. 3 is a perspective view showing the state where head cartridges have been attached (or mounted) onto a carriage of the ink jet recording apparatus according to the first embodiment of the invention.

FIG. 3 is a perspective view showing the state where the head cartridge 200A (black cartridge) and the head cartridge 200B (color cartridge) have been attached onto the carriage 100 in FIG. 1.

In FIGS. 1 and 3, the carriage 100 is driven by a driving mechanism comprising the carriage motor 17, the carriage belt 16, and the like and is reciprocatively moved along the guide rail 14. A side-wall 103L (left side-wall (that is, side wall on the left side)) and a side-wall 103R (right side-wall (that is, side wall on the right side)) on both sides and a middle wall 104 between the side-walls on both sides are provided for the carriage 100. An enclosing portion of the head cartridge 200A (black cartridge) is formed between the side-wall 103L and the middle wall 104 of the carriage 100. An enclosing portion of the head cartridge 200B (color cartridge) is formed between the side-wall 103R and the middle wall 104. As will be understood from FIGS. 1 and 3, the attachment/removal of the head cartridge to/from the carriage 100 is executed almost horizontally from the front surface side of the apparatus main body.

Figure 4:
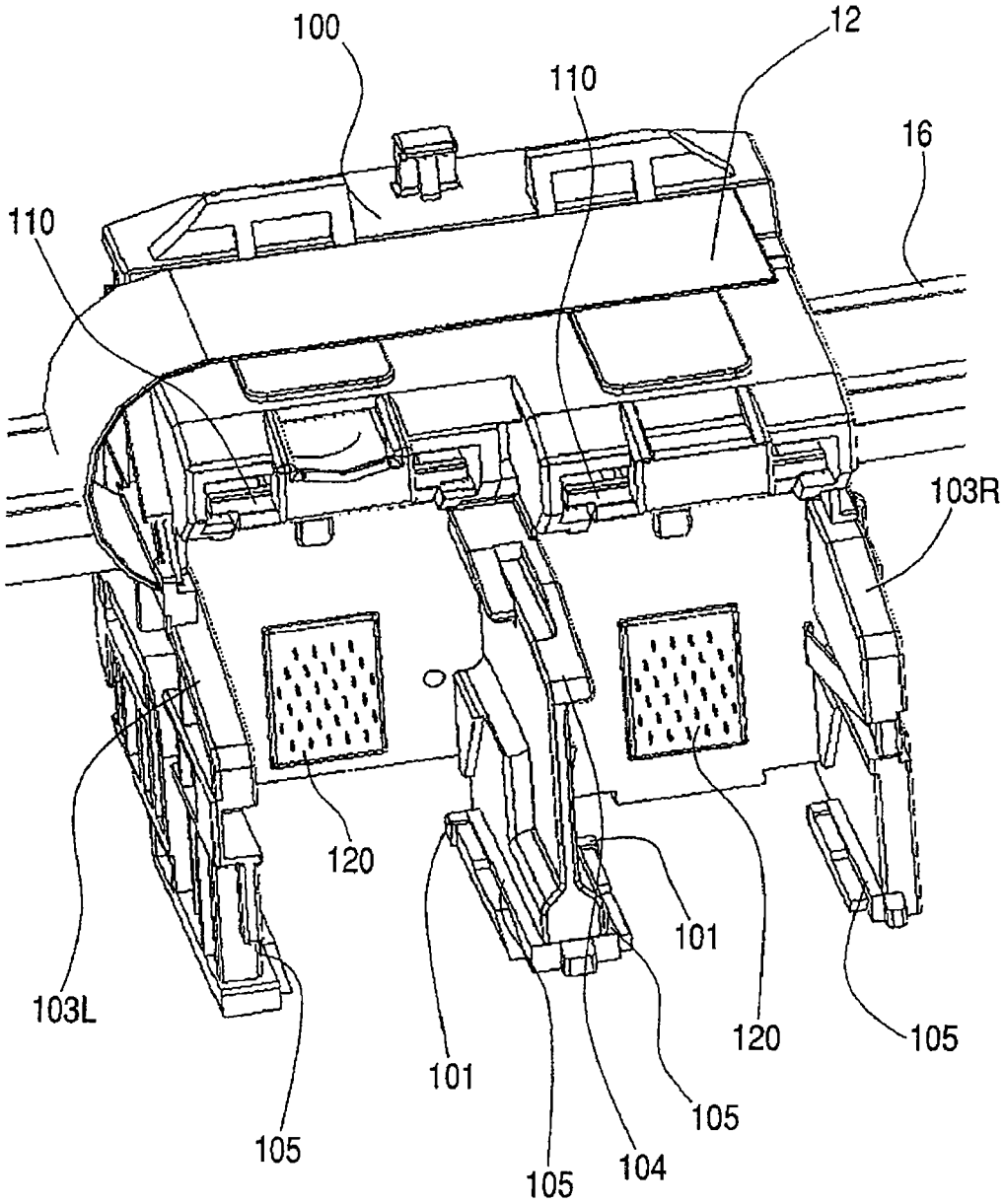
FIG. 4 is a perspective view showing the state of the carriage of the ink jet recording apparatus according to the first embodiment of the invention before the head cartridges are attached.

FIG. 4 is a perspective view showing only the carriage 100. In FIG. 4, a thick portion is formed in each of the lower portions of the both surfaces of the middle wall 104 of the carriage 100 and the lower portions of the inner surfaces of the both side-walls 103L and 103R. Positioning projections 101 with which the positioning grooves 202 of each of the head cartridges 200A and 200B are come into engagement are formed in those thick portions. Guides 105 for guiding the rough guide projections 203 provided for the head cartridges 200A and 200B when each of the head cartridges 200A and 200B is enclosed in the enclosing portion are formed in relatively lower portions of the both side-walls 103L and 103R and the middle wall 104 of the carriage 100. The carriage 100 is also provided with: pressure contact connectors 120 for electrically connecting to the conductor exposing portion 207 (FIGS. 2A and 2B) provided on the contact surface of each of the head cartridges 200A and 200B by being come into contact with the conductor exposing portion 207; and the headset cams 110 which are pressed downward by compression springs (headset springs 111 in FIGS. 5, 6, 7 and 8) in order to easily guide and fix the head cartridges 200A and 200B to the carriage 100.

Figure 5:
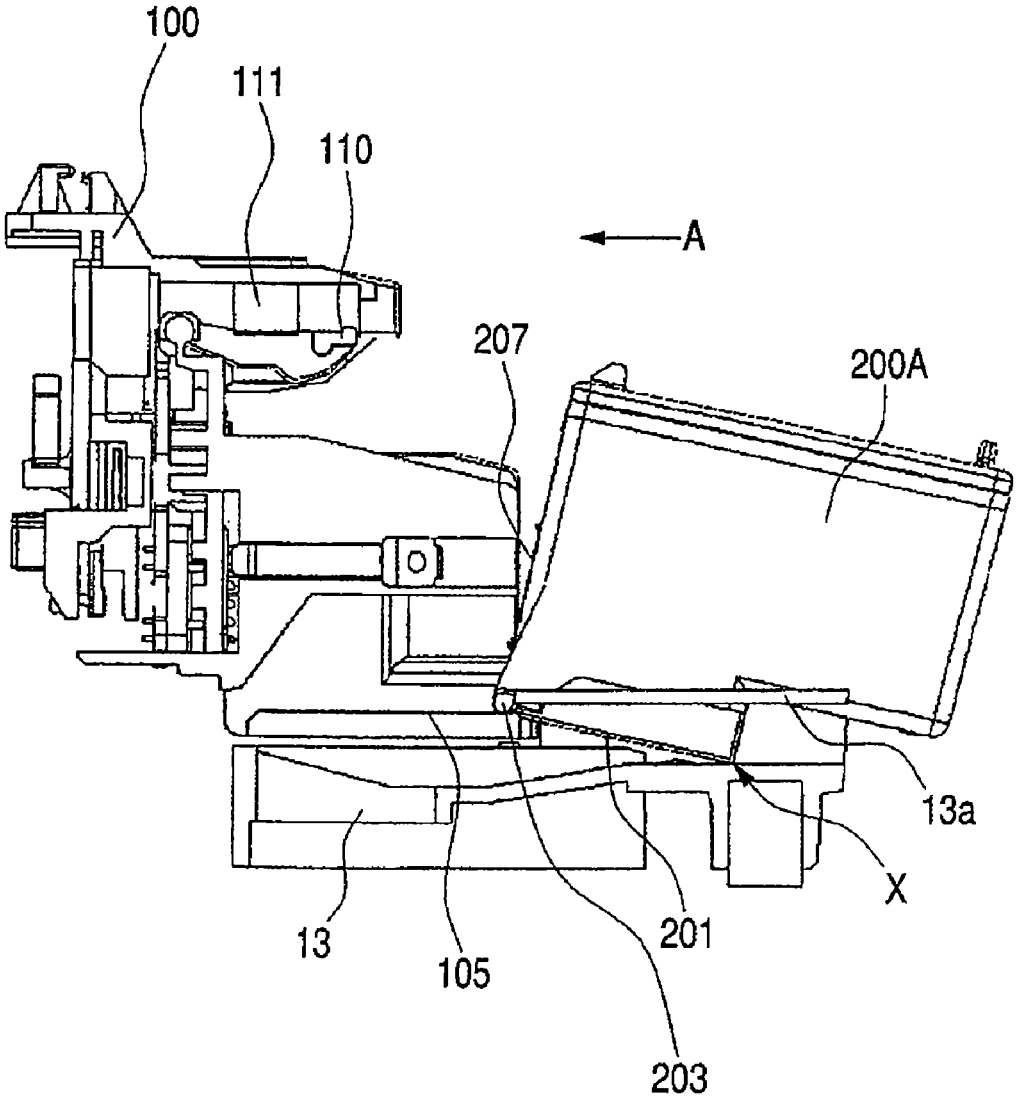
FIG. 5 is a cross sectional view showing the state at the start of the attachment of the head cartridge of the ink jet recording apparatus according to the first embodiment of the invention.
Figure 6:
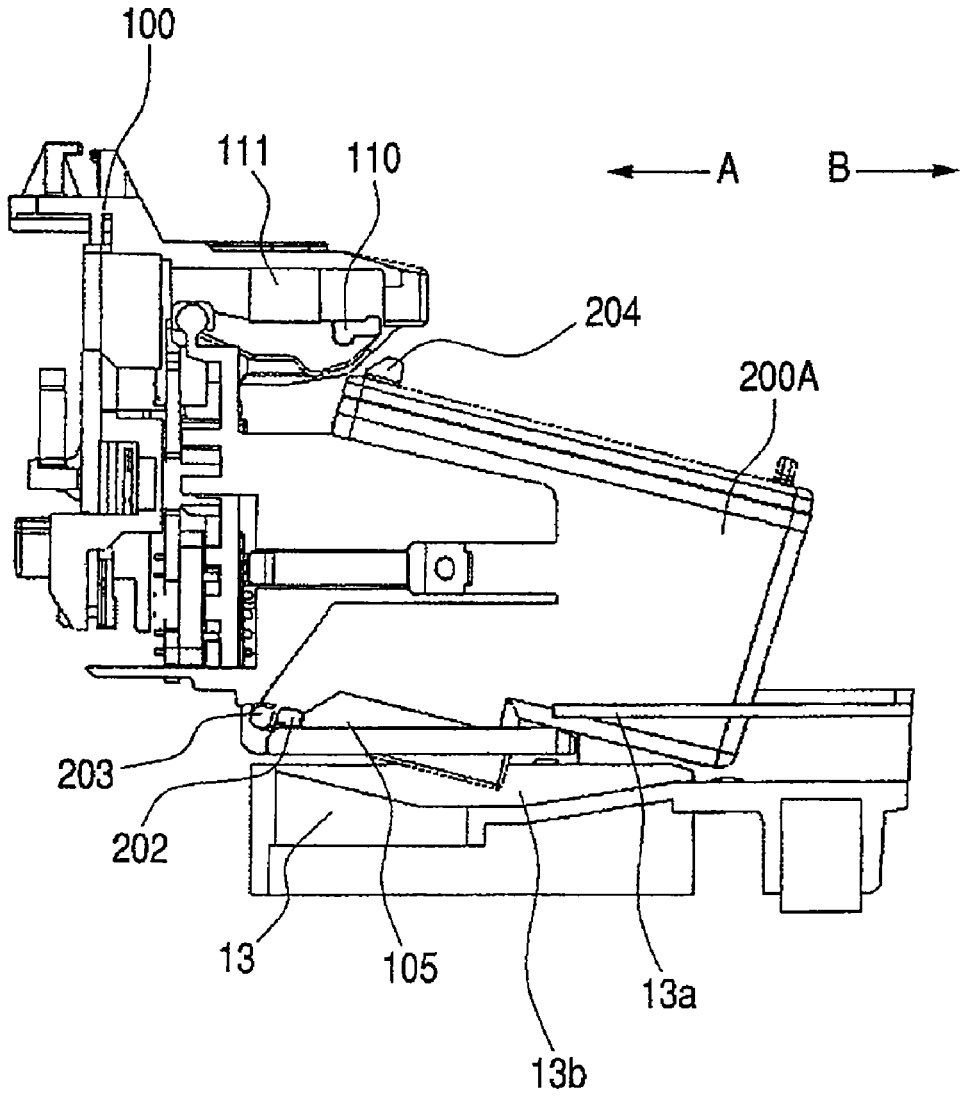
FIG. 6 is a cross sectional view showing the first state during the attaching operation of the head cartridge of the ink jet recording apparatus according to the first embodiment of the invention.
Figure 7:
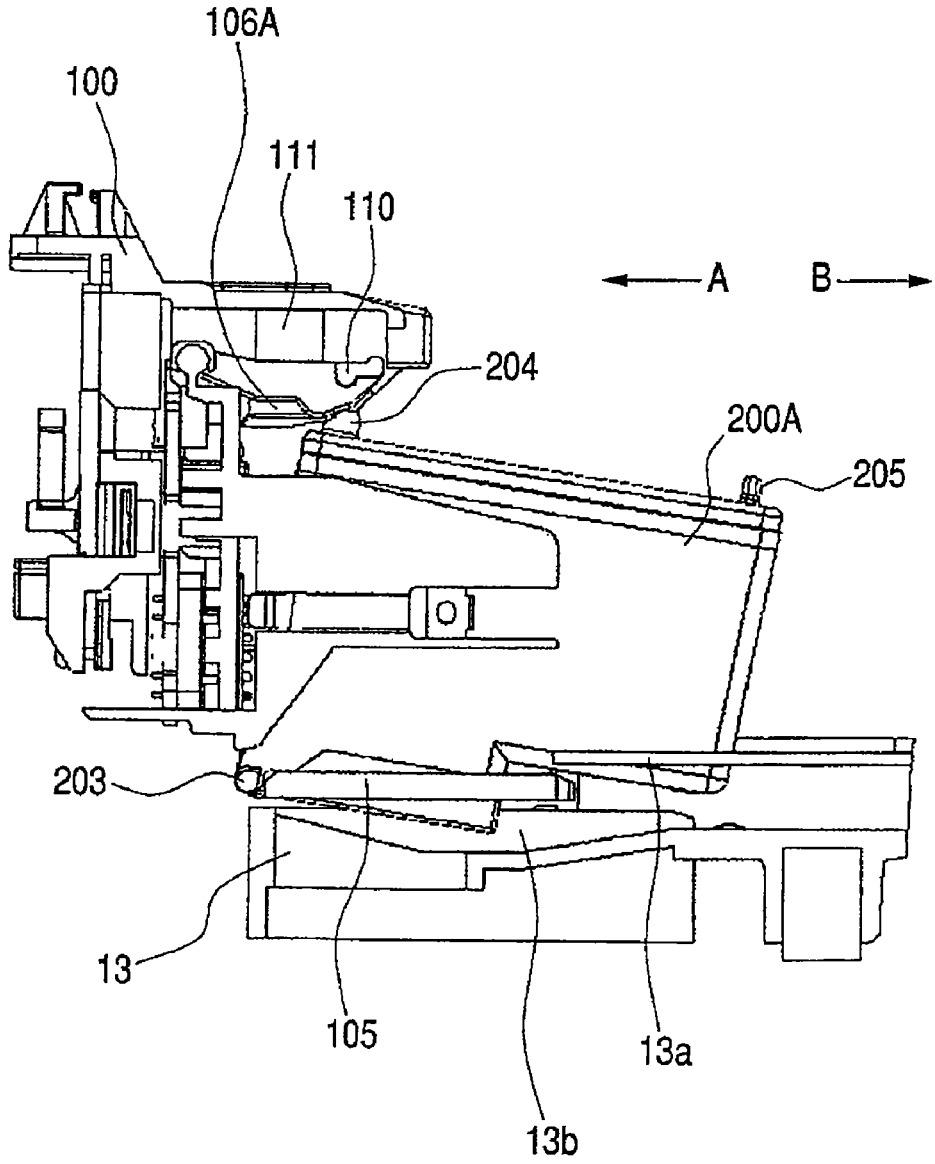
FIG. 7 is a cross sectional view showing the second state during the attaching operation of the head cartridge of the ink jet recording apparatus according to the first embodiment of the invention.
Figure 8:
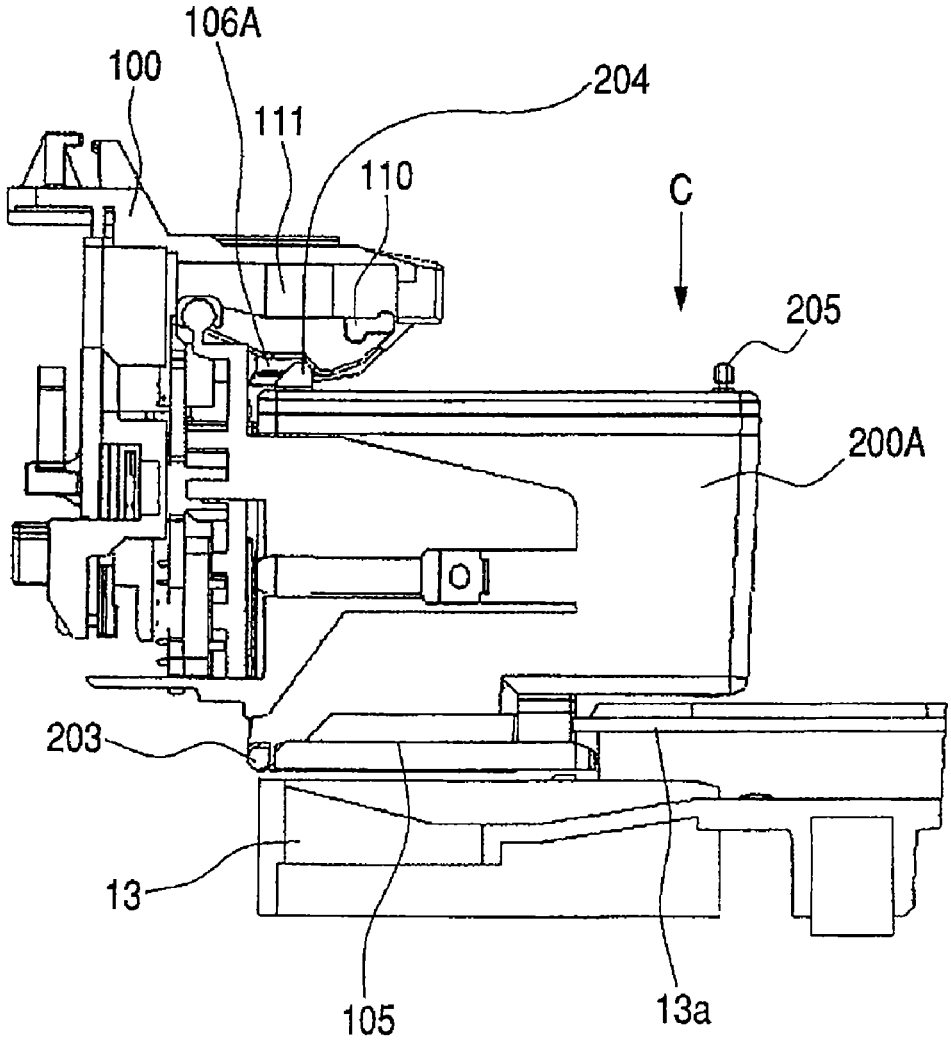
FIG. 8 is a cross sectional view showing the state after completion of the attachment of the head cartridge of the ink jet recording apparatus according to the first embodiment of the invention.

Subsequently, the operation at the time of attaching and removing the head cartridge 200A to/from the carriage 100 will be described. This operation is substantially the same as that for the head cartridge 200B. FIG. 5 is a cross sectional view showing the state at the start of the attachment of the head cartridge. FIGS. 6 and 7 are cross sectional views showing the state during the attachment of the head cartridge. FIG. 8 is a cross sectional view showing the state after completion of the attachment of the head cartridge.

When the head cartridge 200A is attached/removed to/from the carriage 100, the carriage 100 is moved to a position where it overlaps a head supporting base 13 shown in FIGS. 1, 5, and the like and is stopped there. This position is called an exchange position. Projection supporting portions 13*a* to guide and support the rough guide projections 203 on both side surfaces of the head cartridge 200A so as to be properly received to the guides 105 provided for the carriage 100 are provided for the head supporting base 13.

First, at the exchange position, the user sandwiches the head cartridge 200A and inserts the rough guide projections 203 along the projection supporting portions 13*a* of the head supporting base 13 existing in the front direction of the apparatus main body of the carriage 100. Owing to the engagement of the rough guide projections 203 and the projection supporting portions 13*a* of the head supporting base 13, the head cartridge 200A is guided in the direction shown by an arrow A while keeping a predetermined position. As shown in FIG. 5, the rough guide projections 203 of the head cartridge 200A are come into contact with the guides 105 on the carriage 100 constructed so as to be located at a height which is slightly lower than the projection supporting portions 13*a* of the head supporting base 13. At this time, since the guides 105 of the carriage 100 is located at the height lower than the projection supporting portions 13*a* of the head supporting base 13, the rough guide projections 203 do not interfere or collide with the carriage 100. The attaching operation of the head cartridge 200A is not obstructed. In this state, even if the user removes the hand from the cartridge, the progressing position of the head cartridge to the carriage 100 is held. That is, the head cartridge 200A in the state shown in FIG. 5 intends to rotate around the rough guide projections 203 as rotational centers. Therefore, in order to hold the position at the time of the attaching/removing operation of the head cartridge 200A, a rear portion (portion shown by X in FIG. 5) of the face surface having the ink discharge portion 201 of the head cartridge 200A on the side where it is away from the contact surface is come into contact with the head supporting base 13.

Subsequently, when the head cartridge 200A is pushed in the direction shown by the arrow A, the cam rotation oblique surfaces 204*b* provided for the head pressure receiving portions 204 in the upper portion of the head cartridge 200A are come into contact with the headset cams 110. Thus, as shown in FIG. 6, the rough guide projections 203 advance in the direction shown by the arrow A of the carriage 100 while the head cartridge 200A is being rotated clockwise along the shape of the cam surfaces of the headset cams 110. When the user further pushes the head cartridge 200A in the direction of the arrow A, as shown in FIG. 7, the head pressure receiving portions 204 are pressed downward by the headset cams 110 and the rough guide projections 203 are guided downward while being come into engagement with the guides 105.

A deviation in the lateral direction (direction corresponding to the carriage moving direction) of the head cartridge 200A is restricted by the side-wall 103L (side-wall 103R in the case of the head cartridge 200B) of the carriage 100 and the middle wall 104. Therefore, the engagement of the rough guide projections 203 and the guides 105 is not disengaged. The guiding function at the time of inserting the head cartridge 200A into the deep position of the enclosing portion can be sufficiently effected.

When the head cartridge 200A is pushed in the direction shown by the arrow A from the state shown in FIG. 7, the headset cams 110 are come into contact with the head pressure receiving portions 204 by the urging force of the headset springs 111. The head pressure receiving portions 204 climb over a head pressure top dead center which is caused by the urging force of the headset springs 111 and the headset cams 110 and the head cartridge 200A is pulled into the deep position of the carriage 100. When the head cartridge 200A is rotated to the position where it has completely been pulled in by the headset cams 110, as shown in FIG. 8, the positioning grooves (202 in FIGS. 2A and 2B) of the head cartridge 200A collide with abutting portions (not shown) of the positioning projections (101 in FIG. 4) of the carriage 100. Upper abutting portions of the head cartridge 200A are come into contact with engaging portions (not shown) of the carriage 100. Thus, the head cartridge 200A is attached to the carriage 100 in the stable state. In this attaching state, the electrical connection between the conductor exposing portion 207 of the head cartridge 200A and the pressure contact connectors 120 of the carriage 100 is also completed.

By the above operation, the head cartridge 200A is rotated, so that it can be fixed into the headset state (state shown in FIG. 8) without a user's particular consciousness.

In the state where the rough guide projections 203 of the head cartridge 200A in FIG. 7 have been come into engagement with the guides 105, the rough guide projections 203 are located in extended opening portions (wide spaces) of the guides 105 and are in the movable state. Therefore, the operation for rotating the head cartridge 200A and fixing it to a predetermined position is not obstructed.

On the other hand, the removal of the head cartridge 200A (200B) from the carriage 100 is achieved by executing the operation for pulling out the head cartridge 200A in a manner opposite to that upon insertion mentioned above.

That is, first, user pushes the head cartridge 200A downward in the direction shown by an arrow C in the diagram. By pushing the head cartridge 200A downward in the direction of the arrow C, the fixing state of the head cartridge 200A by the headset cams 110 is released and the state as shown in FIG. 7 is obtained. When a convex-shaped head hooking portion 205 is pulled out in the direction shown by an arrow B from the state of FIG. 7, the head cartridge 200A is rotated counterclockwise around the positioning grooves (202 in FIGS. 2A and 2B) of the head cartridge 200A and the positioning projections (101 in FIG. 4) on the carriage 100 as rotational centers and is finally rotated and guided to the position as shown in FIG. 6 where the rough guide projections 203 are come into engagement with the guides 105 of the carriage 100.

In the case of rotating the head cartridge 200A counterclockwise in the attachment/removal of the head cartridge 200A, a space 13*b* enough to allow the head cartridge 200A to be rotated around the positioning grooves (202 in FIGS. 2A and 2B) as rotational centers is formed in the head supporting base 13 lest the face surface having the ink discharge portion 201 or the head cartridge itself interferes and a breakdown or the like occurs.

After that, by pulling out the head cartridge 200A in the direction of the arrow B from the state of FIG. 6, the rough guide projections 203 are pulled out to the front position in the sheet ejecting direction of the apparatus main body along the guides 105 of the carriage 100. At this time, when the rough guide projections 203 advance to the front edges of the guides 105 of the carriage 100, the rough guide projections 203 are come into contact with the projection supporting portions 13*a* of the head supporting base 13 (FIG. 5) since the projection supporting portions 13*a* of the head supporting base 13 are constructed at the positions higher than those of the guides 105 of the carriage 100.

At this time, although the head cartridge 200A intends to rotate around the rough guide projections 203 as rotational centers, in order to hold the position of the head cartridge 200A, the rear portion (portion shown by X in FIG. 5) of the face surface having the ink discharge portion 201 of the head cartridge 200A on the side where it is away from the contact surface is come into contact with the head supporting base 13. Consequently, the head cartridge 200A does not drop.

In the ink jet recording apparatus of the embodiment, a recordable maximum sheet size is set to an LTR (letter) size. The head supporting base 13 is arranged at an acceleration start position of the carriage 100, on the side opposite to the maintenance unit 36 for a recording range (moving range of the carriage 100), at the time of what is called borderless printing of the LTR having a maximum recording range. Owing to such a construction, the apparatus can be constructed without widening a width of whole apparatus. Since the head supporting base 13 is arranged at the acceleration start position of the carriage 100 on the side opposite to the maintenance unit 36 for the recording range, an opening adapted to receive the preliminary discharge of the head cartridge 200A can be also formed in the head supporting base 13.

According to the first embodiment described above with reference to FIGS. 1, 2A, 2B, 3, 4, 5, 6, 7 and 8, the attaching/removing operation in which the drop of the recording means is prevented can be executed without a user's particular consciousness.

Second Embodiment

An additional embodiment which can be provided for the carriage 100 in the foregoing first embodiment will now be described as a second embodiment.

Figure 9:
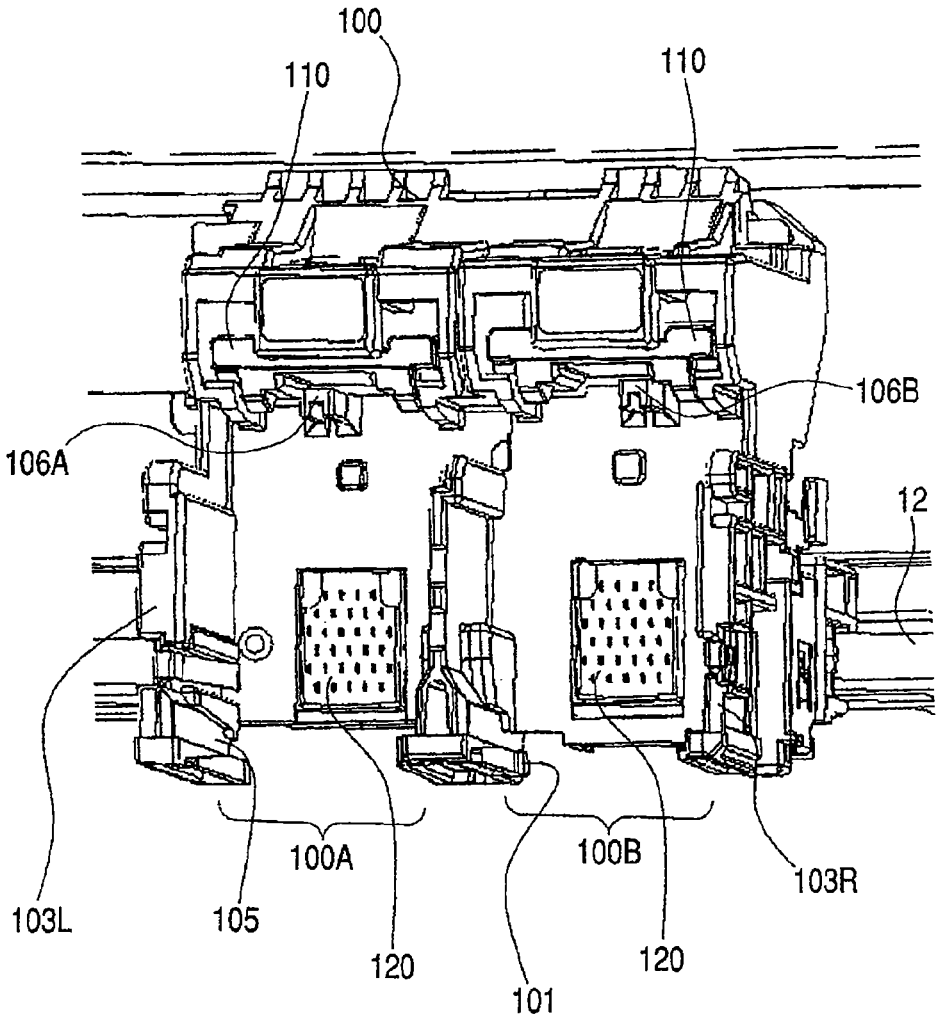
FIG. 9 is a perspective view showing a carriage of an ink jet recording apparatus according to the second embodiment of the invention.
Figure 10A:
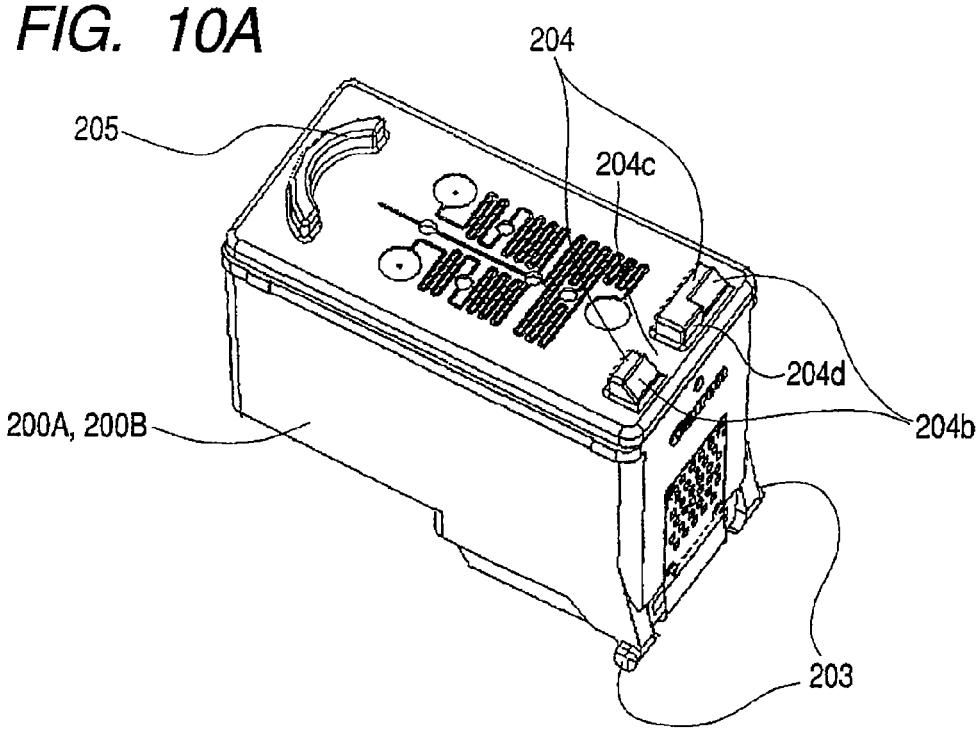
FIGS. 10A and 10B are perspective views showing a head cartridge which is attached onto the carriage in FIG. 9.
Figure 10B:
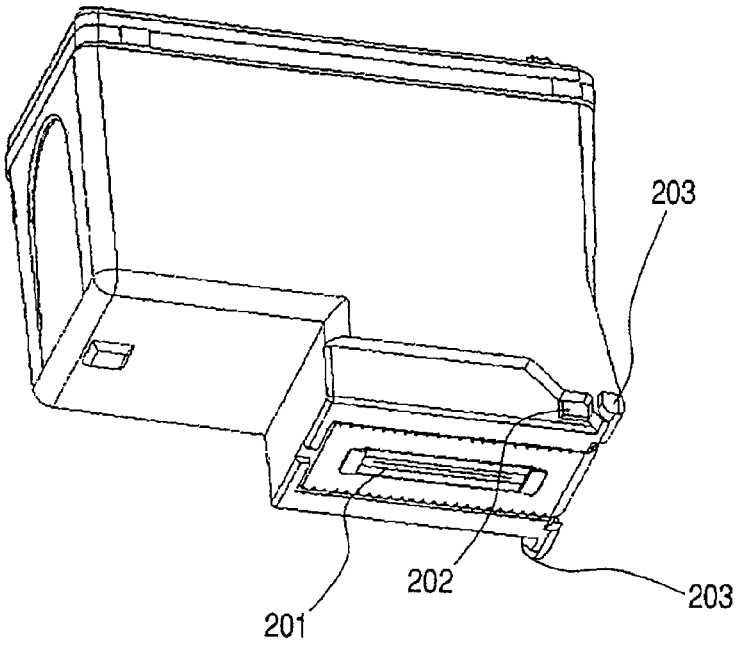

FIG. 9 shows a perspective view of the carriage 100. FIGS. 10A and 10B are perspective views of the head cartridge 200A (200B).

As mentioned above, an enclosing portion 100A to enclose the head cartridge 200A (black cartridge) is formed between the left side-wall 103L and the middle wall 104 of the carriage 100, and an enclosing portion 100B to enclose the head cartridge 200B (color cartridge) is formed between the right side-wall 103R and the middle wall 104 of the carriage 100.

As shown in FIG. 9, projecting portions 106A and 106B adapted to be come into engagement with groove portions (204*c* in FIGS. 10A and 10B) serving as erroneous attachment preventing mechanisms provided for the head cartridges 200A and 200B are formed in relatively upper portions of the enclosing portions 100A and 100B in the carriage 100 so that each of the head cartridges 200A and 200B can be attached only in the correct enclosing portion.

As shown in FIGS. 10A and 10B, the two head pressure receiving portions 204 on the upper surface of the head cartridge 200A (200B) are formed in the carriage moving direction. The groove portion 204*c* and an erroneous attachment preventing surface 204*d* serving as an erroneous attachment preventing mechanism are formed between the head pressure receiving portions 204 at a position which differs in dependence on each head cartridge.

Figure 11:
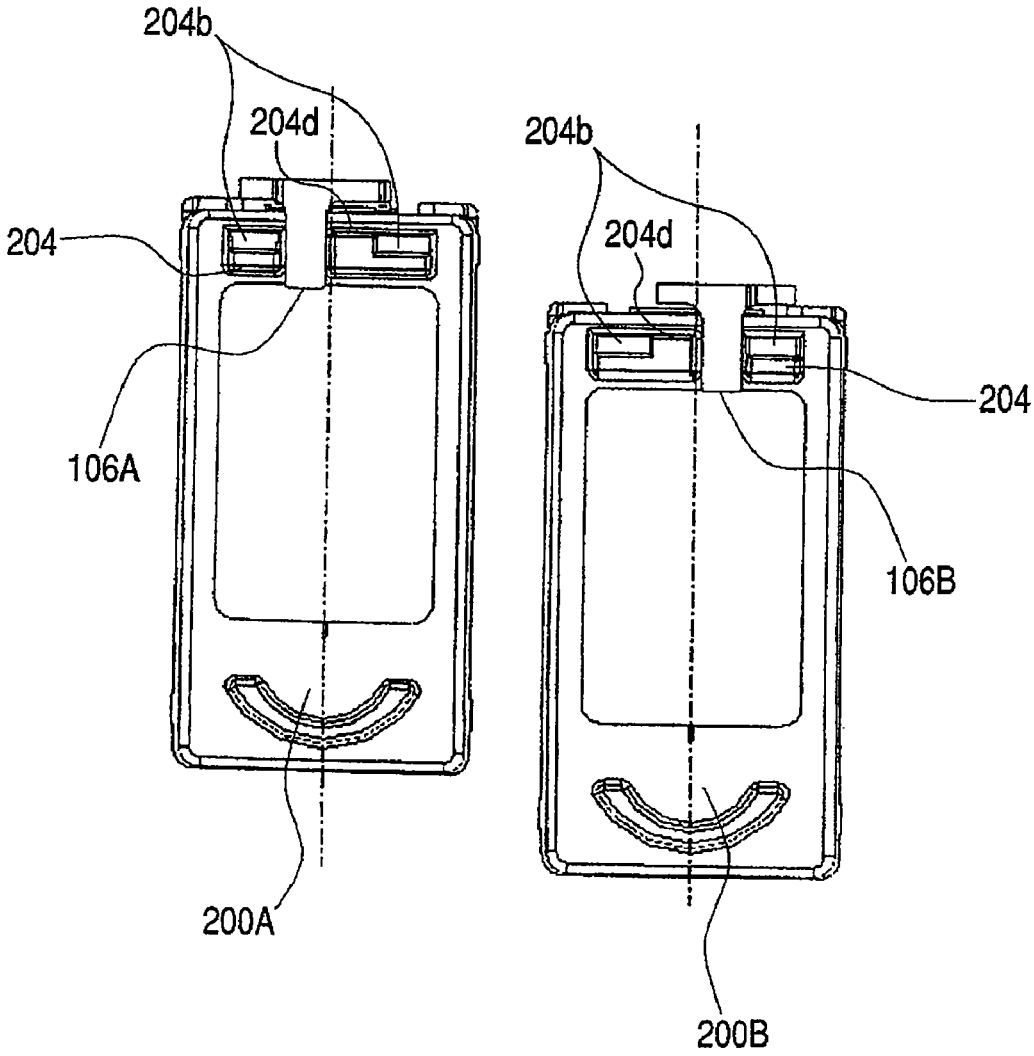
FIG. 11 is a partial plan view showing the state where the head cartridges of FIGS. 10A and 10B have correctly been attached onto the carriage in FIG. 9.

FIG. 11 is a partial plan view showing combinations of the projecting portions 106A and 106B and the head cartridges 200A and 200B in the state where the head cartridge 200A (black cartridge) and the head cartridge 200B (color cartridge) have correctly been attached onto the carriage 100.

The groove portion 204*c* constructed in the head cartridge 200A (black cartridge) and the projecting portion 106A constructed in the enclosing portion 100A of the carriage 100 are arranged on the left side of the center line of the head cartridge 200A in FIG. 11. The erroneous attachment preventing surface 204*d* constructed in the head cartridge 200A (black cartridge) is arranged on the right side of the center line of the head cartridge 200A.

The groove portion 204*c* constructed in the head cartridge 200B (color cartridge) and the projecting portion 106B constructed in the enclosing portion 100B of the carriage 100 are arranged on the right side of the center line of the head cartridge 200B in FIG. 11. The erroneous attachment preventing surface 204*d* constructed in the head cartridge 200B (color cartridge) is arranged on the left side of the center line of the head cartridge 200B.

A situation that the wrong head cartridge is attached and fixed to each of the enclosing portions 100A and 100B provided for the carriage 100 can be prevented by the combinations of the projecting portions 106A and 106B as shown in FIG. 11, the groove portions 204*c* and the erroneous attachment preventing surfaces 204*d* provided for the ink jet head cartridges 200A and 200B, and the like.

The embodiment has been described as an example with respect to the case of preventing the erroneous attachment of the two kinds of head cartridges 200A and 200B and the enclosing portions 100A and 100B of the carriage 100 corresponding to them. The invention is not limited to the number of kinds of head cartridges but can be also similarly applied to the case of not only the construction using one kind of head cartridge but also the ink jet recording apparatus using a number of head cartridges, for example, three or more kinds of head cartridges. Similar effects can be also accomplished by such a construction. In the embodiment, although the shape of the groove portion 204*c* or the shapes of the projecting portions 106A and 106B as an erroneous attachment preventing mechanism differ depending on the kind of color of the head cartridge (black cartridge, color cartridge, or the like), even in the case where the kinds of ink discharge ports differ in dependence on the head cartridge of the same color (the head cartridge for normal printing and the head cartridge for fine printing), naturally, the shape of the erroneous attachment preventing mechanism is changed in each cartridge.

Also in the second embodiment, the operation at the time of attaching and removing the head cartridge 200A (200B) to/from the carriage 100 is fundamentally the same as that in the first embodiment. In the embodiment, if the correct head cartridge is attached to the desired cartridge enclosing portion during the step of shifting from the state of FIG. 7 to the state of FIG. 8 mentioned above, for example, as shown in FIG. 8, the projecting portion 106A of the carriage 100 is inserted into the groove portion (204*c* in FIGS. 10A and 10B) formed between the head pressure receiving portions 204 on the upper surface of the head cartridge 200A and the attachment and fixing of the head cartridge 200A are completed.

In the state where the head cartridge 200A has been fixed as shown in FIG. 8, the projecting portion 106A as an erroneous attachment preventing mechanism is not come into contact with the bottom surface of the groove portion (204*c* in FIGS. 10A and 10B) as an erroneous attachment preventing mechanism.

The head pressure receiving portions 204 which are pressed by the headset cams 110 provided for the carriage 100 are arranged at both side positions in the carriage scanning direction so as to sandwich the groove portion 204*c* as an erroneous attachment preventing mechanism in the carriage scanning direction. This is because it is more preferable in the case where the head cartridge 200A (200B) is come into pressure contact with the pressure contact connector 120 by the headset cams 110 serving as fixing members provided for the carriage 100. That is, when the head cartridge 200A (200B) is attached to the carriage 100, in the rotating direction in the case where the sheet feeding/ejecting direction of the recording sheet is used as a rotational axis, even if the head cartridge 200A (200B) is attached while being twisted, the more the head pressure receiving portions 204 are away from each other in the carriage scanning direction, the more the moment force for correctly pressing the abutting surface formed on the positioning groove 202 of the head cartridge increases and acts. Thus, a situation that the head cartridge is attached in the state where the positioning groove 202 is floating can be prevented. It is important that the head pressure receiving portions 204 are formed at both outer positions in the carriage scanning direction. Consequently, the apparatus is constructed so that the projecting portions 106A and 106B or the groove portion 204*c* is sandwiched in the carriage scanning direction.

The case where the head cartridge 200B (color cartridge) has been inserted into the wrong enclosing portion 100A will now be described.

In this case, when the user inserts the head cartridge 200B into the position shown in the state of FIG. 7 and advances it to the deep position in a manner similar to that described in the foregoing first embodiment, the erroneous attachment preventing surface 204*d* is come into contact with the projecting portion 106A on the carriage 100. Therefore, the head cartridge 200B cannot advance any more. That is, as will be obviously understood from FIGS. 9 and 11, since the erroneous attachment preventing surface 204*d* formed on the head cartridge 200B is come into contact with the projecting portion 106A formed in the enclosing portion 100A, the head cartridge 200B cannot be enclosed into the enclosing portion 100A.

Further, although the cam rotation oblique surfaces 204*b* provided for the head pressure receiving portions 204 of the head cartridge 200B have slightly rotated and pushed upward the headset cams 110, the erroneous attachment preventing surface 204*d* is in contact with the projecting portion 106A on the carriage 100 before the point exceeding the head pressure top dead center. Therefore, the cam rotation oblique surfaces 204*b* of the head pressure receiving portions 204 are pushed and returned to the side opposite to the pressure contact connectors 120 by a reactive force of the headset cams 110. Thus, since the user receives the abutting of the erroneous attachment preventing surface 204*d* and its push-back reactive force, he can easily become aware of the erroneous attachment.

Although the invention has been described with respect to the case where the head cartridge 200B (color cartridge) has erroneously been inserted into the enclosing portion 100A, a similar effect can be also accomplished in the case where the head cartridge 200A (black cartridge) has erroneously been inserted into the enclosing portion 100B.

Although the projecting portions 106A and 106B have been provided for the carriage 100 and the groove portions 204*c* corresponding to them have been provided for the head cartridges 200A and 200B in the embodiment, it is also possible to use a construction in which, on the contrary, the projecting portions 106A and 106B are provided for the recording means and the groove portions 204*c* are provided for the carriage.

According to the foregoing second embodiment, in addition to the effects of the first embodiment mentioned above, the recording means for enabling the user to easily recognize by the simple construction that the recording means has erroneously been attached to the carriage without any particular consciousness can be provided and the ink jet recording apparatus having such recording means can be also provided.

Although the first and second embodiments have been described above as an example with respect to the case of attaching the two recording means (head cartridges 200A and 200B) to the carriage 100, the invention can be freely embodied irrespective of the number of recording heads. That is, the invention can be also similarly applied to not only an ink jet recording apparatus using one recording head but also an ink jet recording apparatus for color recording using a plurality of recording heads using ink of different colors, an ink jet recording apparatus for gradation recording using a plurality of recording heads using ink of different concentration in the same color, or an ink jet recording apparatus based on a combination of them. Similar effects can be also accomplished in such a case.

Further, the invention can be also similarly applied to an arbitrary layout construction of the recording heads and the liquid tank portions (ink tanks) such as construction using exchangeable head cartridges in each of which the recording head and the liquid tank portion are integrated, construction in which the recording head and the liquid tank portion are separately provided and they are connected by a tube or the like for supplying the ink, or the like. In the case of the ink jet recording apparatus, the invention can be applied to the apparatuses using the recording heads using, for example, electromechanical converting elements such as piezoelectric elements or the like. Among them, an excellent effect is derived in an ink jet recording apparatus using the recording heads of a system in which the ink is discharged by using a thermal energy. This is because, according to such a system, high density and high fineness of the recording (printing) can be accomplished.

According to the embodiment, a situation that when the recording means is attached/removed to/from the carriage, the recording means is dropped from the hand of the user and damaged or use of the recording means is disabled can be prevented.

This application claims priority from Japanese Patent Application No. 2005-129409 filed on Apr. 27, 2005, which is hereby incorporated by reference herein.

What is claimed is:

1. An apparatus for recording with a cartridge having a recording head, comprising:

a carriage on which the cartridge is removably attached, and which is movable along a predetermined direction within a range including (i) a recording region where the recording head performs recording on a recording sheet and (ii) an exchange position where the cartridge can be attached to said carriage, said carriage comprising an enclosing portion for enclosing the cartridge and a guide portion for guiding the cartridge into said enclosing portion while supporting a part of the cartridge; and a supporting base adapted to support the cartridge thereon when said cartridge is attached to said carriage, provided at a position corresponding to the exchange position, said supporting base comprising a supporting portion which guides the part of the cartridge to said guide portion of said carriage along a direction which crosses the predetermined direction, wherein said supporting portion of said supporting base is arranged at a position higher than said guide portion, so that said supporting portion advances the part of the cartridge to the guide portion when the cartridge is attached to said carriage, and comes into contact with the part of the cartridge when the cartridge is removed from said carriage.

2. An apparatus according to claim 1, wherein said carriage comprises a plurality of enclosing portions for enclosing a plurality of cartridges.

3. An apparatus according to claim 1, wherein said cartridge comprises a conductor electrically connected to the recording head, and said carriage comprises a pressure contact connector provided in said enclosing portion so as to electrically couple to the conductor when the cartridge is attached to said carriage.

4. An apparatus according to claim 1, wherein said cartridge comprises an ink tank so as to supply ink to the recording head.

5. An apparatus for recording with a cartridge having a recording head, comprising:

a carriage on which the cartridge is removably attached, and which is movable along a predetermined direction within a range including (i) a recording region where the recording head performs recording on a recording sheet and (ii) an exchange position where the cartridge can be attached to said carriage, said carriage comprising an enclosing portion for enclosing the cartridge and a guide portion for guiding the cartridge into said enclosing portion while supporting a part of the cartridge; and a supporting base, provided fixedly at a position corresponding to the exchange position in the predetermined direction, adapted to support the cartridge thereon when said cartridge is attached to said carriage while stopped at the exchange position, said supporting base comprising a supporting portion which guides the part of the cartridge to said guide portion of said carriage along a direction which crosses the predetermined direction.

6. An apparatus according to claim 5, wherein said carriage comprises a plurality of enclosing portions for enclosing a plurality of cartridges.

7. An apparatus according to claim 5, wherein said cartridge comprises a conductor electrically connected to the recording head, and said carriage comprises a pressure contact connector provided in said enclosing portion so as to electrically couple to the conductor when the cartridge is attached to said carriage.

8. An apparatus according to claim 5, wherein said cartridge comprises an ink tank so as to supply ink to the recording head.

* * * * *